US007244468B2

(12) United States Patent
Leonard

(10) Patent No.: US 7,244,468 B2
(45) Date of Patent: Jul. 17, 2007

(54) METHOD OF RETROFITTING A FINISHED SHOE TO PROVIDE ADDITIONAL CUSHIONING MATERIAL

(76) Inventor: Michele Leonard, 298 Montgomery Dr., Mantua, NJ (US) 08051

( * ) Notice: Subject to any disclaimer, the term of this patent is extended or adjusted under 35 U.S.C. 154(b) by 0 days.

(21) Appl. No.: 11/212,249

(22) Filed: Aug. 26, 2005

(65) Prior Publication Data

US 2007/0048442 A1 Mar. 1, 2007

(51) Int. Cl.

| | |
|---|---|
| ***B05D 5/00*** | (2006.01) |
| ***B05D 7/12*** | (2006.01) |
| ***B05D 1/28*** | (2006.01) |
| ***B05D 3/00*** | (2006.01) |
| *A43B 1/00* | (2006.01) |

(52) U.S. Cl. ..... 427/387; 427/389; 427/389.9; 427/429

(58) Field of Classification Search ..... 12/142 N, 12/142 P, 142 Q; 36/1, 83, 98, 25 R, 34 R, 36/43, 45, 71, 76 R, 77 R, 72 R, 140; 427/154, 427/258, 260, 261, 384, 385.5, 387, 389, 427/389.9, 393.5, 394, 429

See application file for complete search history.

(56) References Cited

U.S. PATENT DOCUMENTS

| | | | | |
|---|---|---|---|---|
| 565,328 | A * | 8/1896 | Buhler | 401/122 |
| 1,963,111 | A * | 6/1934 | Backes | 222/457 |
| RE19,475 | E * | 2/1935 | Bollman et al. | |
| 2,004,059 | A * | 6/1935 | Bollman et al. | 523/167 |
| 2,033,758 | A | 3/1936 | Cronan et al. | |
| 2,318,926 | A | 5/1943 | Daniels | |
| 2,361,941 | A | 11/1944 | Harrison | |
| 4,597,195 | A | 7/1986 | Dananberg | |
| 4,608,988 | A | 9/1986 | Dananberg | |
| 5,373,650 | A | 12/1994 | Dananberg et al. | |
| 5,782,015 | A | 7/1998 | Dananberg | |
| 2002/0066209 | A1 | 6/2002 | Steed et al. | |
| 2004/0122138 | A1 | 6/2004 | Sunada et al. | |
| 2005/0182173 | A1 | 8/2005 | Yashima et al. | |
| 2005/0211580 | A1 * | 9/2005 | Kaszubski et al. | 206/223 |

FOREIGN PATENT DOCUMENTS

| | | | |
|---|---|---|---|
| JP | 411127905 | A | 5/1999 |
| JP | 02001335747 | A | 12/2001 |
| JP | 02004194734 | A | 7/2004 |

* cited by examiner

*Primary Examiner*—William Phillip Fletcher, III
(74) *Attorney, Agent, or Firm*—Garcia-Zamor IP Law; Ruy M. Garcia-Zamor

(57) ABSTRACT

A method of retrofitting a finished shoe to provide additional cushioning material. The method includes: providing a curable composition; providing the finished shoe; placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort.

25 Claims, 5 Drawing Sheets

Method Of Retrofitting A Finished Shoe To Provide Additional Cushioning Material Method Of Retrofitting A Finished Shoe To Provide Additional Cushioning Material Method Of Retrofitting A Finished High Heel Shoe To Provide Additional Cushioning Material

METHOD OF RETROFITTING A FINISHED SHOE TO PROVIDE ADDITIONAL CUSHIONING MATERIAL

BACKGROUND

The present invention is generally directed to shoes and, more specifically, to a method of retrofitting a finished shoe to provide additional cushioning material.

Shoe designers continue to try to develop comfortable shoes that consumers can wear without pain. Unfortunately, it is rare that a finished shoe does not aggravate the feet of a significant portion of potential consumers. Conventional finished shoes often rub and abrade a wearer's skin. One common example of shoe irritation is the rubbing against calves by the top of boots. More problematic is the rubbing caused by straps of women's shoes, such as high heel shoes. Often, high heel shoes can only be worn for a short period of time before the associated foot pain increases beyond the wearer's endurance. When a finished shoe aggravates a wearer there are no conventional solutions that are satisfactory.

Some conventional pads that are used when a finished shoe aggravates a foot have three layers. The pads include a solid paper or solid padding layer; an adhesive layer; and a release paper layer. These pads are not very useful because it is difficult to trim the pads down to a small size and because removal of the release paper is often problematic. Additionally, the use of an adhesive layer that is separate from the padding layer often makes it difficult to properly secure the padding layer to the shoe. The padding layer either falls off too easily or the adhesive layer damages the shoe upon removal. The solid padding is also inadequate and unsightly for use in small discreet portions of the shoe, such as the top of a toe box or on a thin strap, such as those found in high heels or sandals. The physical, sheet like properties of solid padding layers makes it difficult to properly place the padding on curved surfaces, such as along the inner sides of shoes near the front of the foot. In addition, the inability to place the padding layer directly onto the shoe limits the ability to provide precise spot coverage in trouble spots.

It would be advantageous to provide method of retrofitting finished shoes to provide additional cushioning material that preferably reduces foot and leg irritation caused by the rubbing of a finished shoe against the skin; that can preferably be used on straps such as those found on finished high heel shoes and the like; that preferably positions cushioning material directly onto the shoe without the use of additional adhesive layers; and that is preferably applied in a liquid and/or gel curable composition that rapidly cures to allow last minute touch ups to shoes close in time to when they will be worn.

SUMMARY

Briefly speaking, one preferred embodiment of the present invention is directed to a method of retrofitting a finished shoe to provide additional cushioning material. The method includes: providing a curable composition. The curable composition includes a base comprising at least one of a liquid latex, a liquid polymer, and a liquid elastomer. A hardener in an amount between approximately one percent and approximately three percent by volume of the curable composition. The hardener being at least one of an amine and an amine derivative. Wherein the hardener facilitates evaporative curing of the curable composition. A catalyst in an amount between approximately five percent and approximately twelve percent by volume of the curable composition. The method also includes: providing the finished shoe; placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, wherein the curable composition substantially cures to form the cushioning material in less than approximately thirty minutes.

In a separate preferred embodiment, the present invention is directed to a method of retrofitting a finished shoe to provide additional cushioning material. The method includes: providing a curable composition that is generally translucent after curing; providing the finished shoe; placing the curable composition on at least a portion of the finished shoe that is configured to contact a wearer's body when the finished shoe is being worn; and allowing the curable composition to cure and form a cushioning material adapted to facilitate wearing of the finished shoe with increased comfort, the portion of the finished shoe on which the cushioning material is located being viewable through the cushioning material, wherein the curable composition substantially cures to form the cushioning material in less than approximately thirty minutes.

In a separate preferred embodiment, the present invention is directed to a method of retrofitting a finished high heel shoe to provide additional cushioning material. The method includes providing a kit including a container enclosing a curable composition that is generally translucent after curing. A lid detachably engaged with the container. The kit also includes an applicator. The method also includes: providing the finished high heel shoe; placing the curable composition directly on a surface of a strap of the finished high heel shoe that is adapted to contact a wearer's leg; the curable composition having sufficient adhesion for application on and curing generally in position on the surface of the strap; and allowing the curable composition to cure and form a cushioning material adapted to facilitate wearing of the finished high heel shoe with increased comfort, the portion of the finished high heel shoe on which the cushioning material is located being viewable through the cushioning material, wherein the curable composition substantially cures to form the cushioning material in less than approximately thirty minutes.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
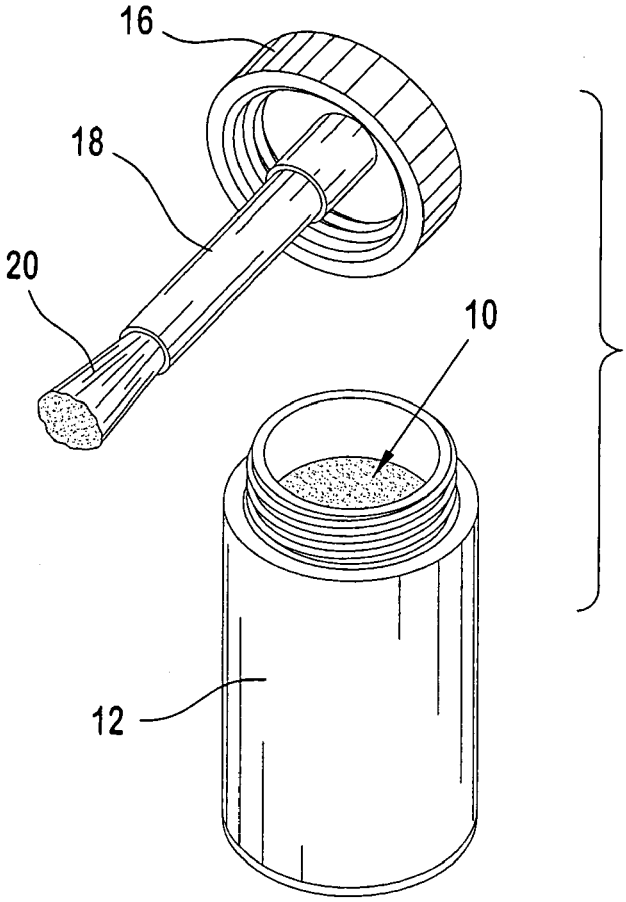
FIG. 1 is a perspective view of a kit formed by a container housing curable composition according to a preferred embodiment of the present invention; the illustrated kit also includes a lid and an applicator.
Figure 2:
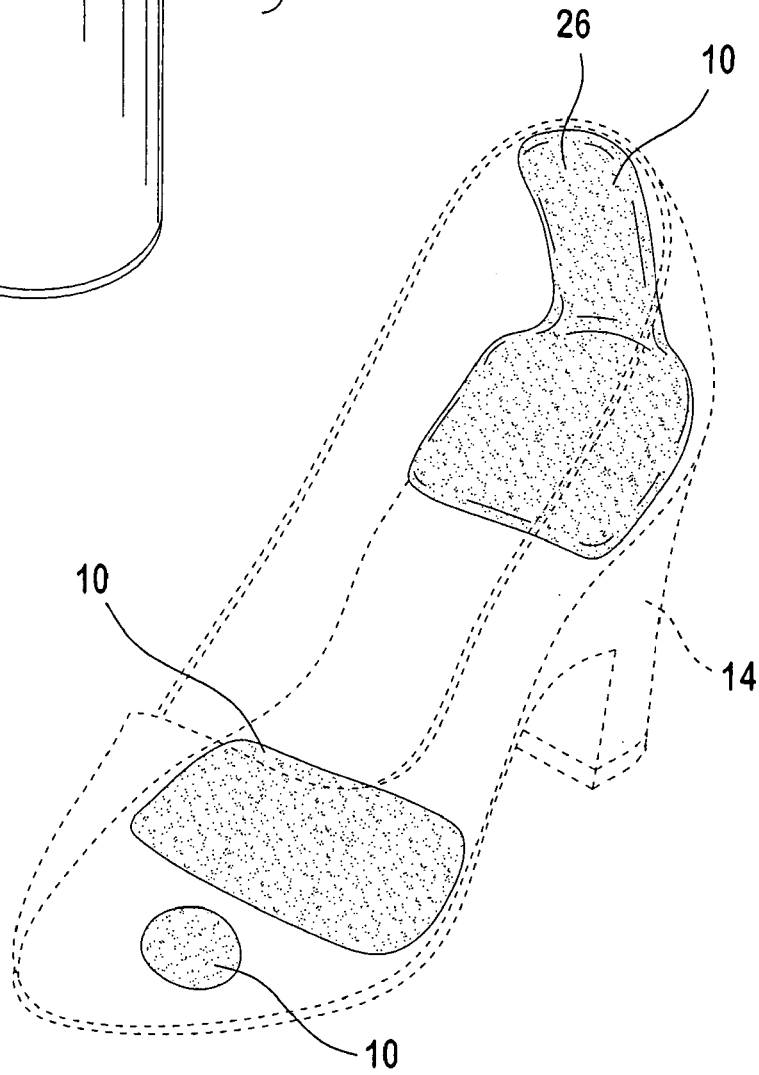
FIG. 2 is a perspective view of a finished shoe that has been retrofit according to a preferred method of the present invention to provide additional cushioning material; the finished shoe has curable composition positioned thereon and some of the curable composition has substantially cured to form cushioning material.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the curable composition and designated parts thereof. The word "finished shoe", as used in the claims and in the corresponding portions of the specification, means "a shoe whose body has been manufactured and is generally complete (not including closures, such as laces, snaps, hook and loop material, and the like)". The curable composition of the present invention is preferably a supplemental retrofit that is added to an already generally complete (i.e., finished) shoe. The term "shoe", as used in the claims and in the corresponding portions of the specification, means "any one of a shoe, sneaker, dress shoe, loafer, boot, slipper, or other footwear." The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Figure 3:
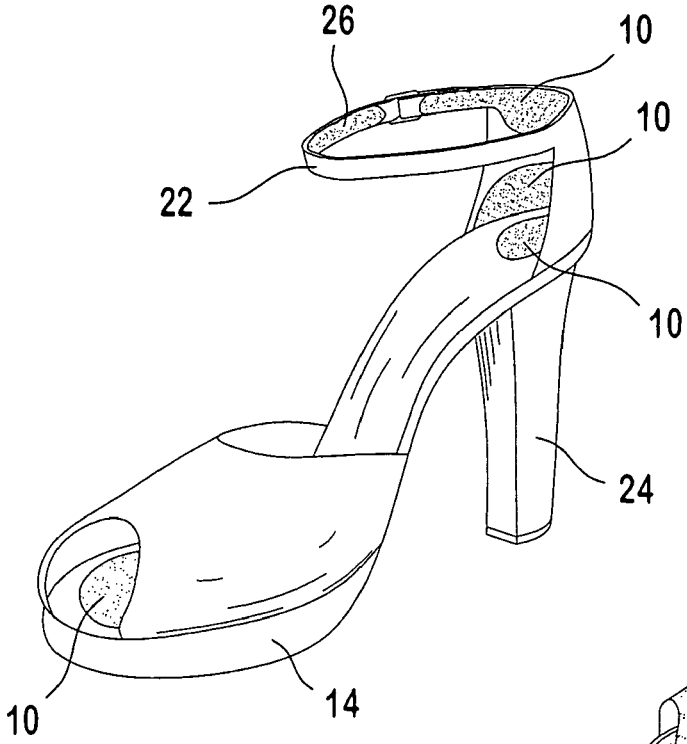
FIG. 3 is a perspective view of a high heel shoe that has been retrofit according to a preferred method of the present invention.
Figure 4:
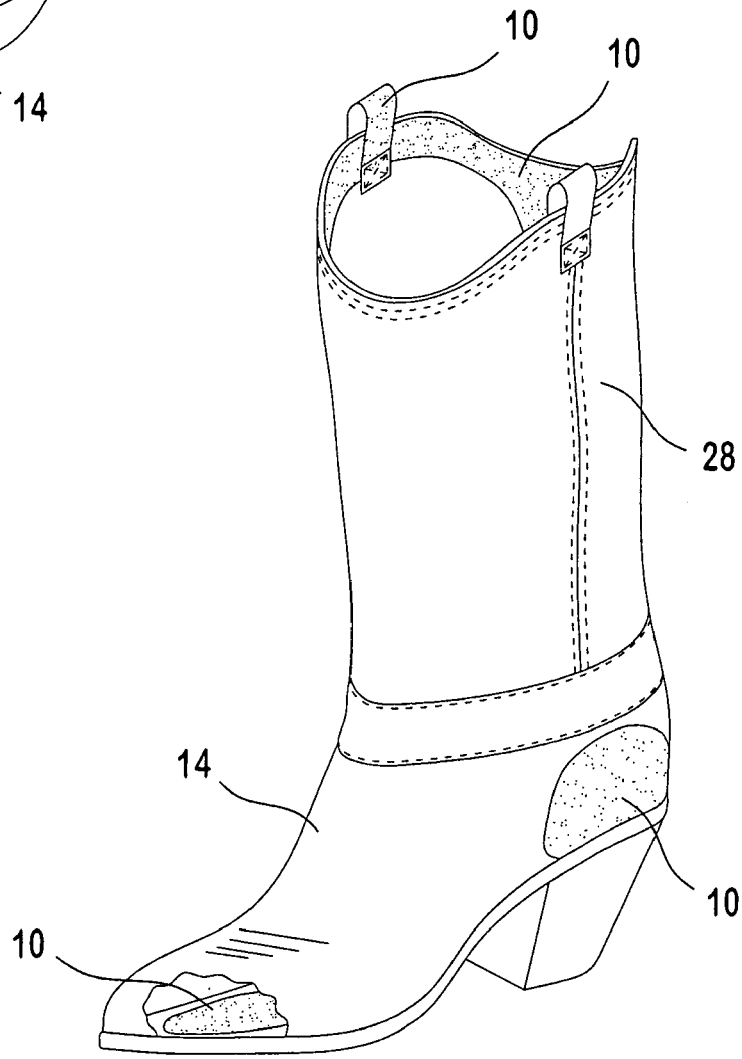
FIG. 4 is a perspective view of a boot that has been retrofit according to a preferred method of the present invention; the boot is partially broken away to show curable material inside the boot; curable material has also been placed along the outside of the boot to prevent scuffing.
Figure 5:
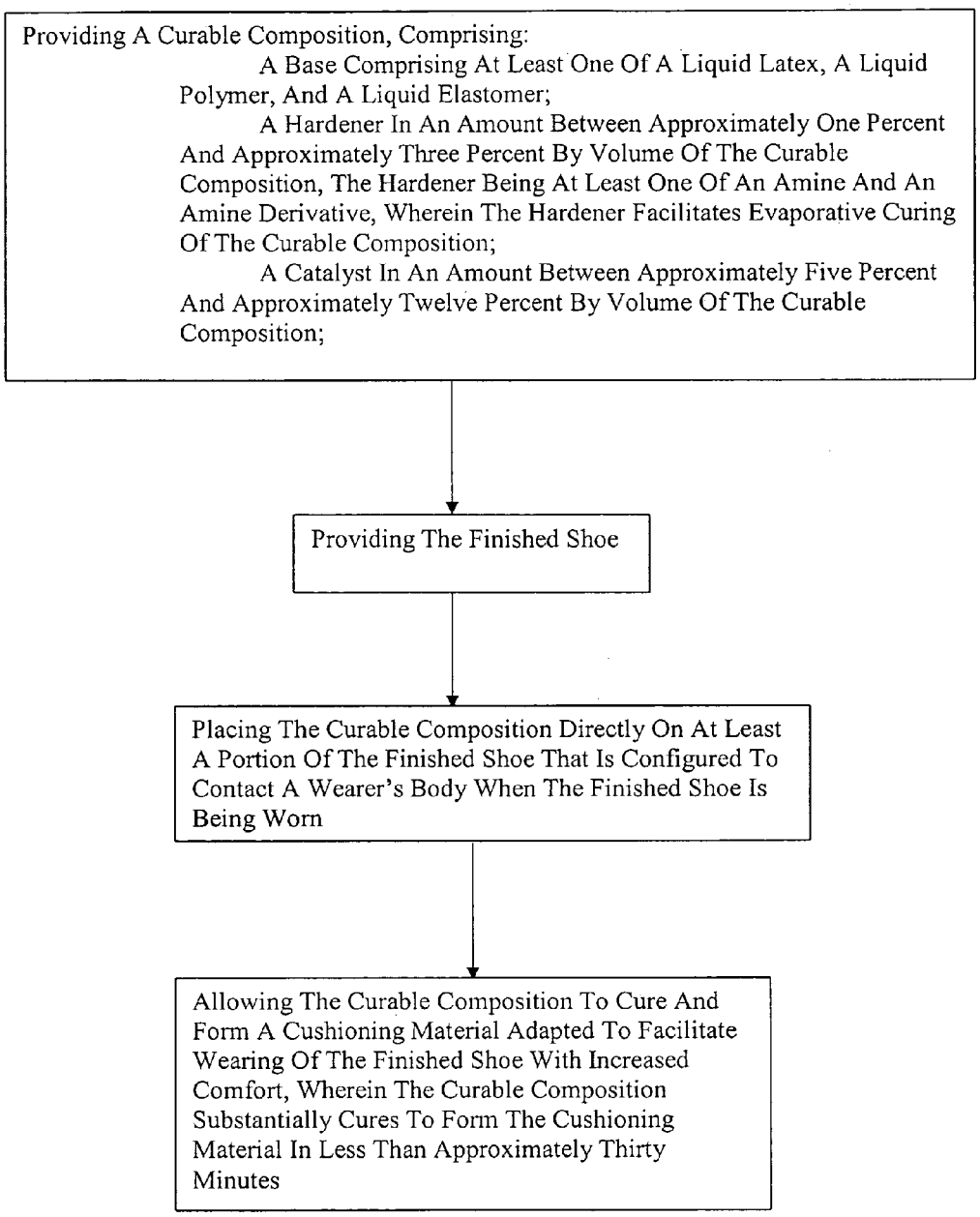
FIG. 5 is a flowchart of a preferred method of retrofitting a finished shoe to provide additional cushioning material according to the present invention.
Figure 6:
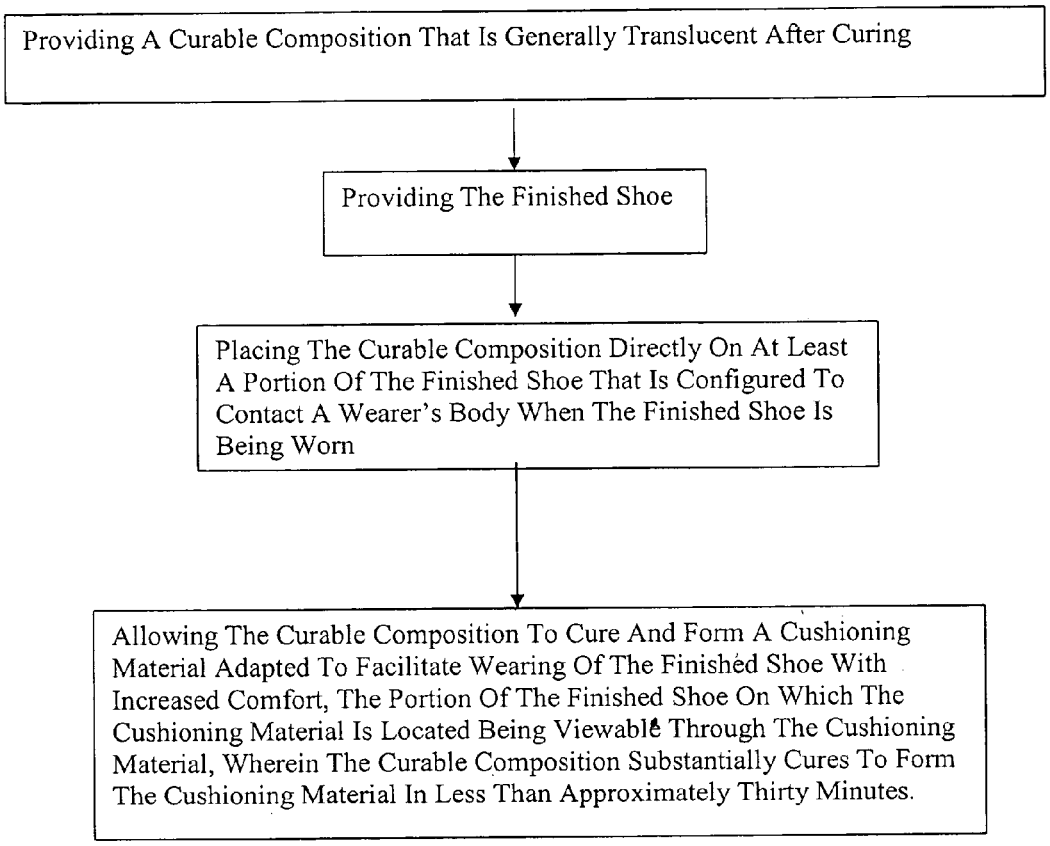
FIG. 6 is a flowchart of a second preferred method of retrofitting a finished shoe to provide additional cushioning material according to the present invention.
Figure 7:
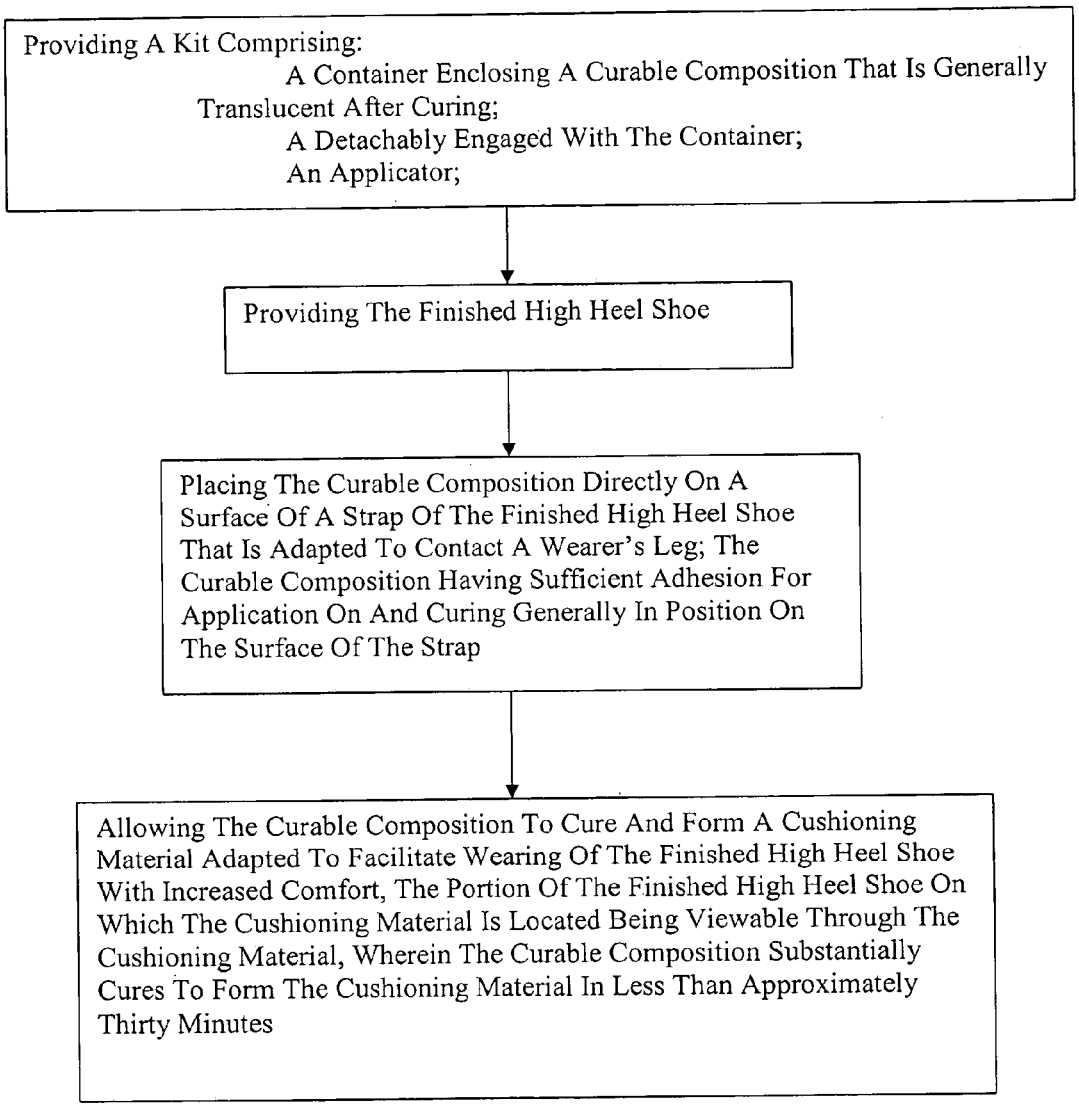
FIG. 7 is a flowchart of a third preferred method of retrofitting a finished shoe to provide additional cushioning material according to the present invention.

Referring to FIGS. 1-7, wherein like numerals indicate like elements throughout, there is shown a preferred embodiment of a curable compound, generally designated 10. Briefly stated, the curable compound allows for simplified retrofit of finished shoes 14 to provide additional cushioning. FIGS. 5-7 illustrate three preferred methods according to the present invention.

Referring to FIGS. 2-5, one preferred method of the present invention includes providing a curable composition 10. The composition 10 preferably includes a base that is formed by at least one of a liquid latex, a liquid polymer, and a liquid elastomer. The base is preferably, but not necessarily, between approximately eighty five (85) percent and approximately eighty eight (88) percent by volume of the curable composition 10. It is preferred that the base is formed by liquid rubber. One preferred chemical formula for hydrogenated rubber that can be used as the base is:

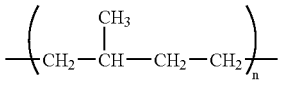

Those of ordinary skill in the art will appreciate from this disclosure that any suitable material can be used as the base of the curable composition 10 without departing from the scope of the present invention.

The composition preferably also includes a hardener. The hardener is preferably present in an amount of between approximately one (1) percent and approximately (3) three percent by volume of the curable composition 10. The hardener(s) preferably reduce curing time and are formed by at least one of an amine and an amine derivative. The curable composition 10 preferably hardens using evaporative curing which can be facilitated by the hardeners. A preferred hardener is aromatic amine. However, those of ordinary skill in the art will appreciate from this disclosure that any suitable hardeners can be used without departing from the scope of the present invention. Hardeners can be omitted if desired without departing from the scope of the present invention.

The curable composition 10 preferably includes a catalyst. The catalyst is preferably present in an amount of between approximately five (5) percent and approximately twelve (12) percent by volume of the curable composition 10. The catalyst is preferably silicone. Those of ordinary skill in the art will appreciate from this disclosure that will appreciate that any suitable catalyst can be used without departing from the scope of the present invention.

The catalyst preferably enhances the ability of the cured composition to be peeled off of a finished shoe 14 without damaging the shoe and can also be used to modify the tackiness of the curable composition 10. The tackiness of the composition can affect how easy it is to adhere the curable composition 10 to a finished shoe 14. It is preferred that the curable composition 10 have sufficient tackiness/adhesion for application onto and generally curing in place on a non vertical surface of the finished shoe 14. As such, the curable composition 10 can be placed on a portion of a shoe that touches the top of one's foot or toes; can be placed on a side of a shoe; can be placed on a shoe strap 22 or web; can be placed in a ring around the top of a boot 28; can be positioned in the heel area of the shoe; or similar areas for curing in the desired shoe location.

It is preferred that the curable composition 10 is generally translucent after curing so that the portion of the finished shoe 14 on which the cushioning material 26 (which is formed by the cured composition) is located can be viewed through the cushioning material 26. This allows the curable composition 10 to be used on areas of shoes exposed to the public without being easily seen by others. This makes the curable composition 10 especially good for use with high heel shoes 24 and other shoes having webbing and straps 22, regardless of the orientation of the straps or webbing 22 during application.

One alternate formula for producing one (1) ounce (i.e., 30 milliliters) of the curable compound 10 is:

| | |
|---|---|
| 25.6 milliliters | of liquid rubber (which is preferably part of the base); |
| 0.2 milliliters | of styrene (which is preferably part of the hardener); |
| 0.2 milliliters | of aromatic amine (which is preferably part of the |

-continued

| | |
|---|---|
| | hardener); |
| 3 milliliters | of mono acrylic (which is preferably part of the accelerator - further described below); |
| 1 milliliter | of glycerin (which is preferably part of the catalyst). |

Another alternate formula for producing one (1) ounce (i.e., 30 milliliters) of the curable compound 10 is:

| | |
|---|---|
| 25 milliliters | of liquid plastic (which is preferably part of the base); |
| 0.8 milliliters | of liquid silicone (which is preferably an additive to provide lubrication to the base and lower the viscosity of the base); |
| 0.2 milliliters | of diethanolamine (which is preferably part of the hardener); |
| 4 milliliters | of latex (which is preferably part of the catalyst). |

While a preferred curable composition 10 and alternate formulas have been described above, those of ordinary skill in the art will appreciate from this disclosure that any suitable composition can be used without departing from the scope of the present invention. For example, the curable compound 10 may include an accelerator without departing from the scope of the present invention. The accelerator is preferably present in the curable composition 10 in an amount of between approximately one (1) percent and approximately three (3) percent by volume of the curable composition 10. The accelerator(s) can be formed by mono acrylic or any other suitable material.

Referring to FIGS. 1 and 7, it is preferred, but not necessary, that the curable composition 10 is part of kit which includes a container 12, a lid 16, and an applicator 18. It is preferable that the applicator 18 is attached to an inner surface of the lid 16. The kit may also include additional applicators 18 that are separate from the lid 16. The applicator 18 preferably has bristles 20 on an end that are used to remove the curable composition 10 from the container 12 and to position the curable composition 10 on the finished shoe 14. By placing the curable composition 10 directly on the shoe, rough shoe surfaces can be evened out with a layer of cushioning material 26 (i.e., the curable composition 10 after substantial curing) that is one sixteenth (1/16) of an inch thick or less. Thicker layers of cushioning material 26 are possible if desired without departing from the scope of the present invention.

The method also includes the step of providing a finished shoe 14. Referring to FIGS. 5-7, curable composition 10 is then directly positioned on at least a portion of the finished shoe 14 that is configured to contact a wearer's body when the finished shoe 14 is being worn. Directly positioned means that the curable composition 10 can be positioned on the finished shoe 14 without a separate adhesive layer or the like. As best shown in FIG. 3, it is preferred that the curable composition 10 can be placed on a surface of a strap 22 of a high heel shoe 24 that is adapted to contact a wearer's leg.

The curable composition 10 may have sufficient adhesion for application onto and for curing generally in position on the surface of the strap 22 regardless of the orientation of the strap 22. It is also preferred that the curable composition 10 is generally translucent and/or transparent after curing so that the surface of the strap 22 on which the cushioning material 26 is located can be viewed through the cushioning material 26.

Referring to FIG. 4, the curable composition 10 may have sufficient adhesion for placement along a boot 28. This is especially useful as a remedy for abrasions caused by the upper edges of boots 28.

The method also includes allowing the curable composition 10 to cure and form a cushioning material 26 adapted to facilitate wearing of the finished shoe 14 with increased comfort. The curable composition 10 preferable substantially cures to form the cushioning material 26 in less than approximately thirty (30) minutes. The rapid curing allows for impromptu adjustments to shoes close in time to when the shoes are going to be worn. For example, shoes can be tried on prior to showering and dressing for an outing. If trouble/irritation spots are felt in the shoe, a wearer can apply the curable composition 10 to the troubling areas and then prepare for the outing or event. By the time the wearer is ready to leave, the shoe(s) 14 will have substantially cured cushioning material 26 in the desired locations. One of ordinary skill in the art will appreciate from this disclosure that the nature of the composition 10 that under the majority of uses, the composition 10 will readily cure in about ten minutes. As such, a range of between ten to thirty minutes in curing time is supported by this disclosure. One of ordinary skill in the art would also readily appreciate from this disclosure that curing time will vary depending on a number of environmental factors, such as temperature, humidity, the material upon which the composition 10 is placed, as well as the thickness of the layer of composition 10 being applied. As such, one of ordinary skill in the art would appreciate from this disclosure that in some uses the composition 10 would cure in as short a time as two minutes if a very thin layer were applied, such as when the composition 10 is being used to touch up a previously applied layer of composition 10. As such, a range of between two to thirty minutes in curing time is supported by this disclosure. "Substantially cured", as used in the claims and in the corresponding portions of the specification, means "cured sufficiently for the cured material to be used without detrimental effects", such as unacceptable distortion of the area over which the curable composition 10 is intentionally positioned. It is more preferable that the curable composition 10 is substantially cured within less than twenty (20) minutes.

It is preferred that the curable composition 10 has sufficient peelability to allow separation of the cushioning material 26 from the finished shoe 14 without damaging the finished shoe 14 by pulling the cushioning material 26 away from the finished shoe 14.

Referring to FIG. 6, one preferred method of the present invention operates as follows. Curable composition 10 is provided that is generally translucent after substantial curing. A finished shoe 14 is provided. Curable composition 10 is placed on at least a portion of the finished shoe 14 that is configured to contact a wearer's body when the finished shoe 14 is being worn. The curable composition 10 is allowed to substantially cure and form a cushioning material 26 that is adapted to facilitate wearing of the finished shoe 14 with increased comfort. The portion of the finished shoe 14 on which the cushioning material 26 is located is viewable through the cushioning material 26. The curable composition 10 preferably substantially cures to form the cushioning material 26 in less than approximately thirty minutes.

The curable composition 10 is an efficient and effective tool for retrofitting finished shoes that may otherwise be unusable or uncomfortable. Additionally, the cushioning material 26 can be positioned near the ball of a foot to prevent the toes from being jammed forward. The cushioning material 26 is also effective for keeping skinny straps properly positioned on a foot for maximum aesthetic appeal. The cushioning material 26 can smooth spots between toes or even be used to soften metal buckles or smooth rough shoe material. The cushioning material 26 can replace the use of band-aids and moleskin to make finished shoes 14 comfortable. Even better, the positioning of cushioning material 26 along the upper portions of boots 28 or similar finished shoes 14 can prevent runs and snags in hosiery.

It is recognized by those skilled in the art that changes may be made to the above described methods and/or curable composition 10 without departing from the broad inventive concept thereof. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of retrofitting a finished shoe to provide additional cushioning material:

providing a curable composition, comprising:

a base comprising at least one of a liquid latex, a liquid polymer, and a liquid elastomer;

a hardener in an amount between approximately one percent and approximately three percent by volume of the curable composition, the hardener being at least one of an amine and an amine derivative, wherein the hardener facilitates evaporative curing of the curable composition;

a catalyst in an amount between approximately five percent and approximately twelve percent by volume of the curable composition;

providing the finished shoe;

placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, wherein the curable composition substantially cures to form the cushioning material in between approximately twenty minutes and approximately thirty minutes.

2. The method of claim 1, wherein the step of providing the curable composition further comprises providing a curable composition that is generally translucent after curing so that the portion of the finished shoe on which the cushioning material is located can be viewed through the cushioning material.

3. The method of claim 1, wherein the step of providing the curable composition further comprises providing the curable composition comprising the base formed by liquid rubber.

4. The method of claim 3, wherein the step of providing the curable composition further comprises providing the curable composition comprising the hardener formed by aromatic amine.

5. The method of claim 4, wherein the step of providing the curable composition further comprises providing the curable composition comprising the catalyst formed by silicone.

6. The method of claim 5, wherein the step of providing the curable composition further comprises providing the curable composition comprising an accelerator in an amount between approximately one percent and approximately three percent by volume of the curable composition.

7. The method of claim 5, wherein the step of providing the curable composition comprises the curable composition having sufficient adhesion for application and curing on a non horizontal surface of the finished shoe.

8. The method of claim 1, wherein the step of providing the curable composition comprises the curable composition having sufficient adhesion for application and curing on non horizontal surface of the finished shoe.

9. The method of claim 5, wherein the step of placing the curable composition the finished shoe comprises placing the curable composition on a surface of a strap of a high heel shoe that is adapted to contact a wearer's leg; the curable composition having sufficient adhesion for application on and curing generally in position on the surface of the strap.

10. The method of claim 9, wherein the step of providing the curable composition further comprises providing a curable composition that is generally translucent after curing so that the surface of the strap on which the cushioning material is located can be viewed through the cushioning material.

11. The method of claim 5, wherein the step of placing the curable composition on the finished shoe comprises placing the curable composition on a surface of a boot that is adapted to contact a wearer's leg; the curable composition having sufficient adhesion for application on and curing generally in position on the surface of the boot.

12. The method of claim 1, wherein the step of placing the curable composition on the finished shoe comprises placing the curable composition on a surface of a strap of a high heel shoe that is adapted to contact a wearer's leg; the curable composition having sufficient adhesion for application on and curing generally in position on the surface of the strap regardless of the orientation of the strap.

13. The method of claim 12, wherein the step of providing the curable composition further comprises providing a curable composition that is generally translucent after curing so that the surface of the strap on which the cushioning material is located can be viewed through the cushioning material.

14. The method of claim 1, wherein the step of placing the curable composition on the finished shoe comprises placing the curable composition on a surface of a boot that is adapted to contact a wearer's leg; the curable composition having sufficient adhesion for application on and curing generally in position on the surface of the boot.

15. The method of claim 1, wherein the step of providing a curable composition further comprises providing a curable composition that has sufficient peelability to allow separation of the cushioning material from the finished shoe without damaging the finished shoe by pulling the cushioning material away from the finished shoe.

16. The method of claim 12, wherein the step of providing the curable composition comprises providing the curable composition in a container having a lid with an attached applicator.

17. The method of claim 12, wherein the step of providing the curable composition comprises the catalyst being glycerin.

18. The method of claim 12, wherein the step of providing the curable composition comprises: the base including liquid plastic; the hardener being diethanolamine; and the catalyst being latex.

19. A method of retrofitting a finished shoe to provide additional cushioning material:

providing a curable composition that is generally translucent after curing;

providing the finished shoe;

placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, the portion of the finished shoe on which the cushioning material is located being viewable through the cushioning material, wherein the curable composition substantially cures to form the cushioning material in between approximately twenty minutes and approximately thirty minutes.

20. The method of claim 19, wherein the step of placing the curable composition on the finished shoe comprises placing the curable composition on a surface of a strap of a high heel shoe that is adapted to contact a wearer's leg; the curable composition having sufficient adhesion for application on and curing generally in position on the surface of the strap regardless of the orientation of the strap.

21. A method of retrofitting a finished high heel shoe to provide additional cushioning material:

providing a kit comprising:

a container enclosing a curable composition that is generally translucent after curing;

a lid detachably engaged with the container;

an applicator;

providing the finished high heel shoe;

placing the curable composition directly on a surface of a strap of the finished high heel shoe that is adapted to contact a wearer's leg; the curable composition having sufficient adhesion for application on and curing generally in position on the surface of the strap; and allowing the curable composition to cure and form a cushioning material adapted to facilitate wearing of the finished high heel shoe with increased comfort, the portion of the finished high heel shoe on which the cushioning material is located being viewable through the cushioning material, wherein the curable composition substantially cures to form the cushioning material in between approximately twenty minutes and approximately thirty minutes.

22. The method of claim 21, wherein the step of providing the kit further comprises the applicator being attached to an inner surface of the lid.

23. A method of retrofitting a finished shoe to provide additional cushioning material:

providing a curable composition, comprising:

a base comprising at least one of a liquid latex, a liquid polymer, and a liquid elastomer;

a hardener in an amount between approximately one percent and approximately three percent by volume of the curable composition, the hardener being at least one of an amine and an amine derivative, wherein the hardener facilitates evaporative curing of the curable composition;

a catalyst in an amount between approximately five percent and approximately twelve percent by volume of the curable composition;

providing the finished shoe;

placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, wherein the curable composition substantially cures to form the cushioning material in between approximately ten minutes and approximately thirty minutes.

24. A method of retrofitting a finished shoe to provide additional cushioning material:

providing a curable composition that is generally translucent after curing;

providing the finished shoe;

placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, the portion of the finished shoe on which the cushioning material is located being viewable through the cushioning material, wherein the curable composition substantially cures to form the cushioning material in between approximately ten minutes and approximately thirty minutes.

25. A method of retrofitting a finished shoe to provide additional cushioning material:

providing a curable composition that is generally translucent after curing;

providing the finished shoe;

placing the curable composition directly on at least a portion of the finished shoe that is configured to contact a wearer's body when the finished shoe is being worn; and allowing the curable composition to cure and form a cushioning material adapted to facilitate wearing of the finished shoe with increased comfort, the portion of the finished shoe on which the cushioning material is located being viewable through the cushioning material, wherein the curable composition substantially cures to form the cushioning material in between approximately two minutes and approximately thirty minutes.

* * * * *